US005702242A

United States Patent [19]

Nied-Menninger et al.

[11] Patent Number: 5,702,242

[45] Date of Patent: Dec. 30, 1997

[54] VANE PUMP

[75] Inventors: Thomas Nied-Menninger; Randolf Körtge, both of Usingen; Bernd Denfeld, Bad Homburg, all of Germany

[73] Assignee: Luk Fahrzeug-Hydraulik GmbH & Co., Bad Homburg, Germany

[21] Appl. No.: 429,417

[22] Filed: Apr. 26, 1995

[30] Foreign Application Priority Data

Apr. 26, 1994 [DE] Germany ..... 44 15 214.0
Feb. 14, 1995 [DE] Germany ..... 195 04 773.7

[51] Int. Cl.[6] ..... F04C 2/00

[52] U.S. Cl. ..... 418/150; 418/259

[58] Field of Search ..... 418/150, 209, 418/268, 259

[56] References Cited

U.S. PATENT DOCUMENTS 2,330,565 9/1943 Eckart ..... 418/266
2,791,185 5/1957 Bohnhoff et al. ..... 418/150
4,702,684 10/1987 Takao et al. ..... 418/259
4,738,603 4/1988 Hattori ..... 418/150

*Primary Examiner*—Charles G. Freay
*Attorney, Agent, or Firm*—Anderson Kill & Olick P.C.

[57] ABSTRACT

A vane pump including a rotor, which is arranged within a cam ring located in the pump housing, and which carries a plurality of radially displaceable vanes which are also displaceable along the inner double-symmetrical contour of the cam ring, with the inner contour defining two diametrically opposite pump chambers and with each chamber being divided in three sections forming, respectively, a suction region, a pressure region, and a separation region between the suction and pressure regions.

3 Claims, 2 Drawing Sheets

VANE PUMP

BACKGROUND OF THE INVENTION

The present invention relates to a vane pump including a rotor, which is arranged within a cam ring, located in the pump housing, and which carries a plurality of radially displaceable vanes which are also displaceable along the inner double-symmetrical contour of the cam ring which inner contour defines two diametrically opposite pump chambers.

The vane pumps of this type are known. During rotation of the rotor, the vanes are displaced along the cam ring inner contour by a generated centrifugal force and by a pressure beneath the vanes, which is produced by the pumped medium. At that, the well known functions of a pump, suction and delivery, take place. In the known double-stroke vane pumps, each of the pump chambers, which, as discussed, are defined by the inner contour of the cam ring, has a suction region and a pressure region separated by a separation region. Further separation region is provided between the suction region of each pump chamber and the pressure region of another pump chamber. These separation regions are formed by so-called small arcs, whereas the separation regions between the suction and pressure regions of the same pump chamber are formed by so-called big arcs. The vanes displaceable along the inner contour of the cam ring have, dependent on their stroke, predetermined speed and acceleration characteristics in the radial direction. A drawback of the known vane pumps consists in that the radial acceleration of a vane, when the vane moves along the separation regions of the inner contour of the cam ring, is characterized by jumps of the acceleration, which can result in radial jumps of the vane displaceable along the separation region. This leads, on one hand, to an increased leakage, and, on the other hand, to an increased noise generation, which are caused by the vanes being lifting off the inner contour of the cam ring and subsequently engaging the inner contour.

European publication EP 0151983 discloses a vane pump including a cam ring the inner contour of which defines two diametrically opposite pump chambers, and a rotor equipped with eight vanes. The pump chambers have each an entry arcuate region divided in a constant speed region, an acceleration region and a deceleration regions. By this shaping of the entry arcuate region, which includes the separation region between the pressure region of one pump chamber and the suction region of the other pump chamber, the leakage should be prevented. However the drawback of this structure consists in that the inner contour of the cam ring requires an arrangement of the vanes along the cam circumference with a spacing of 45° therebetween, so that a total of eight vanes should be provided in the rotor. This results, on one hand, in high assembly costs, because of large number of parts, and, on the other hand in that the formation of the separation region between a pressure region of one pump chamber and the suction region of the other pump chamber cannot be insured. Further, the profile of the entry arcuate region of the vane pump of EP 0151 983 leads to jumps of the radial speed of vanes when they traverse the entry arcuate region.

Accordingly an object of the invention is a vane pump of a type described above which is formed of fewer parts and in which the leakage between the pump chambers is reduced to a minimum.

SUMMARY OF THE INVENTION

This and other objects of the invention, which will become apparent hereinafter, are achieved by dividing a portion of the inner contour defining one pump chamber into three sections forming, respectively, a suction region, a pressure region, and a separation region therebetween. Because the inner contour in the region of each pump chamber is divided in three equal sections, with each section occupying an angular region of about 60°, the rotor can advantageously be provided with six vanes arranged along the rotor circumference with a spacing between adjacent vanes of about 60°. Thus, advantageously a fewer number of parts is used, and the number of chambers, defined by the vanes, is also reduced to six. This permits to improve the output pulsation of the vane pump. Simultaneously, the pressure fluctuation is also improved, whereby noise generation, which is dependent thereon, is reduced.

In a preferred embodiment of the invention, the pump chambers pass into each other so that they do not cause a discontinuous change in a radial speed characteristic of the vane displacement which is influenced by the inner contour of the cam ring, and the inner contour has no arcuate regions in the separation regions between the pressure region of one pump chamber and the suction region of another pump chamber, and the pressure region of the another pump chamber and the suction region of the one pump chamber. Thereby, it is advantageously achieved that the original dynamic radial characteristics of vane drop only in that region, and thereby the vane speed is not subjected in this region to abrupt changes and, because of a small angular region of a steady varying stroke, the vane radial speed continuously changes in this region. Because the acceleration defines the first derivative of the speed with respect to time, the occurrence of jumps of radial acceleration in the separation region is prevented. This prevents lifting of a vane off the inner contour and, thereby, leakage between the pump chambers is minimized. Simultaneously, noise generation is substantially reduced. Because no lifting of the vanes off the inner contour takes place, there is no subsequent engagement of the vanes with the inner contour, which causes the noise.

BRIEF DESCRIPTION OF THE DRAWINGS

The objects and features of the present invention will become more apparent, and the invention itself will be best understood from the following detailed description of the preferred embodiment when read with reference to the appending drawings, wherein.

DETAILED DESCRIPTION OF THE PREFERRED EMBODIMENT

Figure 1:
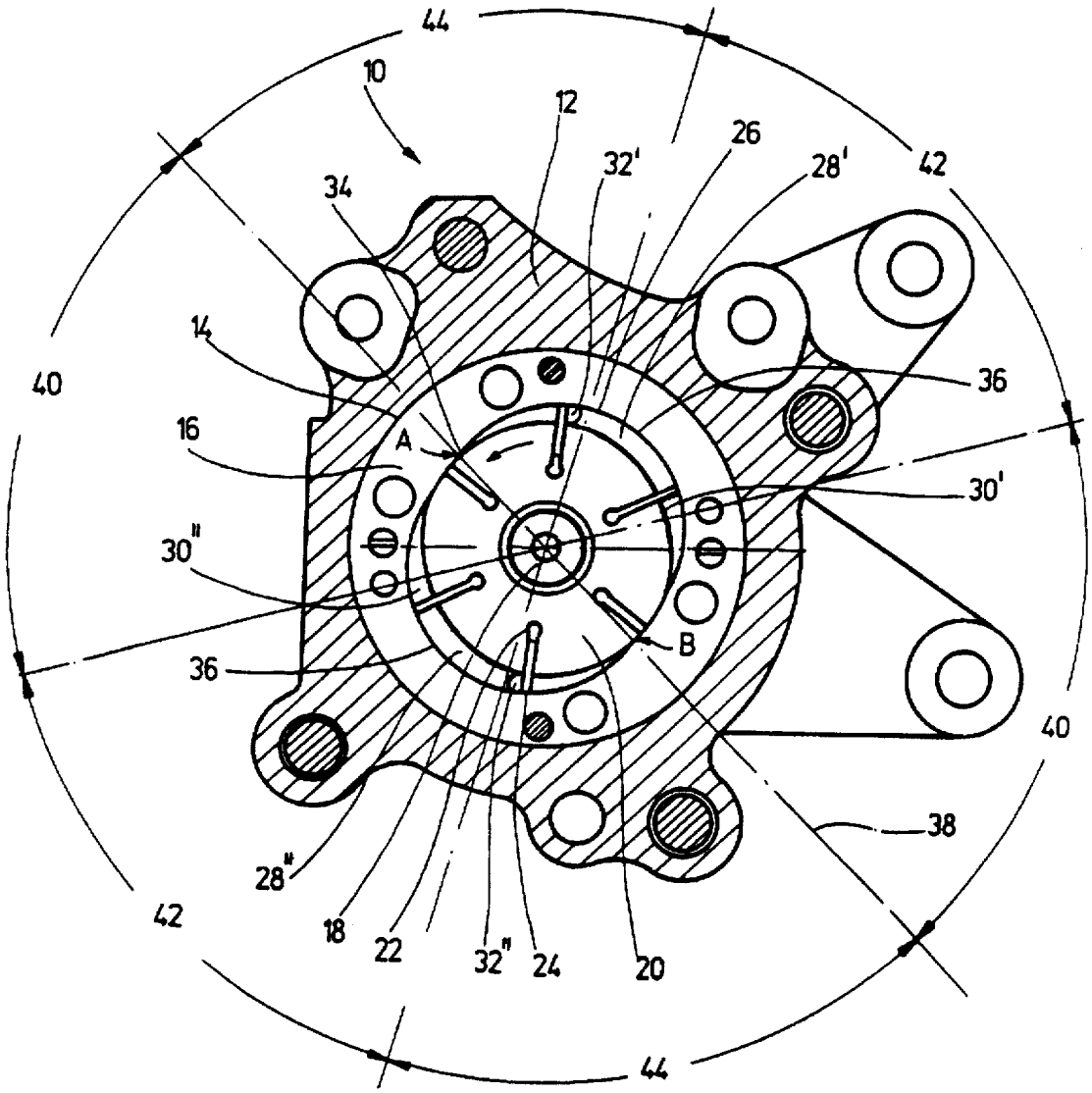
FIG. 1 is a cross-sectional view of a vane pump according to the present invention.

A vane pump 10 according to the present invention, which is shown in FIG. 1, has a housing 12 in the cavity 14 of which a cam ring 16 is arranged. A rotor 20, which is fixedly mounted on a drive shaft 18 for joint rotation therewith, is located inside the cam ring 16. The rotor 20 is arranged centrally with respect to the cavity 14 or the cam ring 16. The rotor 20 is provided with radial slots 22 in which radially displaceable vanes 24 are located. The rotor 20 has totally six slots 22 which are arranged along the rotor circumference every 60°.

The cam ring 16 has an inner contour 26 which includes two diametrically opposite pump chambers 28' and 28". The pump chambers 28' and 28" have each a suction region 30', 30", connected with an inlet opening, and a pressure region 32', 32", connected with an outlet opening. The suction region 30' of the first pump chamber 28' is separated from the pressure region 32" of the second pump chamber 28' by a first separation region 34 formed by the inner contour 26. Opposite the first separation region 34, there is provided another separation region that separates the pressure region 32' of the first pump chamber 28' from the suction region 30' of the second pump chamber 28". The inner contour 26 also has a second separation region 36 that separates the suction region 30', 30" and the pressure region 32', 32" of each pump chamber 28', 28".

By forming the suction regions 30', 30", the pressure region 32', 32" as well as the second separation regions 36, the pump chambers 28', 28" are divided each in three sections 40, 42, 44. Each section occupies an angular region of 60°. Thus, they have the same dimension. The suction region 30', 30" is located in the section 40, the second separation region 36 is located in the section 42, and the pressure region 32', 32" is located in the section 44.

In the first separation region 34, the inner contour 26 has no other contoured region, so that the inner contour smoothly passes from the pressure regions 32', 32" into the suction regions 30', 30". The separation region 34 is thus determined by thickness of the vane 24 at a corresponding position of the rotor 20 at an angle 0° or at an opposite angle 180°. In FIG. 1, there is shown a radial line 38 passing through the angle 0° or 180°. The point A is characterized by 0° and the point B is characterized by 180°, with the rotor 20 being movable in a counter-clockwise direction.

The pump 10 shown in FIG. 1 functions as follows:

During the operation of the vane pump 10, the rotor 20 is driven by the shaft 18, and the vanes 24 are displaced outwardly and, thus, along the inner contour 26 by a centrifugal force and, additionally, by pressure under the vanes in the slots 22. Because of the profile of the inner contour 26, the vanes exit from the suction regions 30', 30" and enter the pressure regions 32', 32". Thus, during the rotation of the rotor 20, the vanes 24 make a certain radial stroke, with a certain radial speed and a certain radial acceleration (as defined by diagrams of FIGS. 2–4).

During the exit of vanes 24 from the suction regions 30', 30" of the pump chambers 28', 28", pump pockets are formed between the vanes 24. Because totally six vanes 24 are provided, in each pump chamber 28', 28", maximum three pockets are formed. At an assumed position of the rotor 20, at which one vane 24 occupies the position A or 0° position and one vane 24 occupies the position B or 180° position, in each pump chamber 28', 28", a first pocket is formed in the suction region 30', 30", a second pocket is formed in the pressure region 32', 32", and a third pocket is formed in the second separation region 36 between the suction region 30', 30" and the pressure region 32', 32".

The separation between the pressure regions 32', 32" and the suction regions 30', 30" of the two pump chambers 28', 28", respectively, is effected with at least one vane 24. The inner contour 26 is so formed that the vanes 24 in the first separation regions 34 have no displacement region of their own, i.e., a radial stroke which lies exclusively in the first separation region 34.

Figure 2:
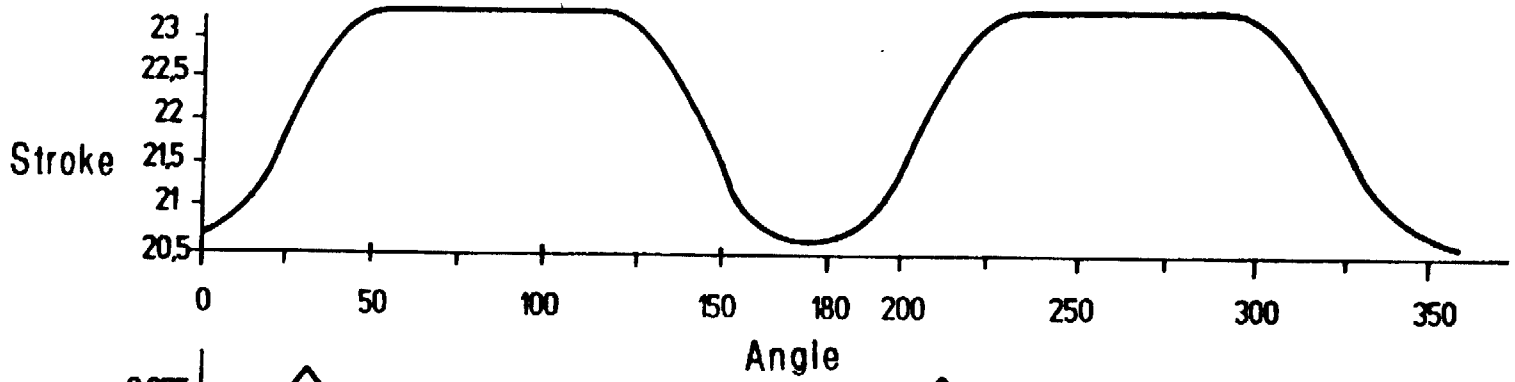
FIG. 2 is a diagram showing a radial path characteristic of a vane of the vane pump shown in FIG. 1.
Figure 3:
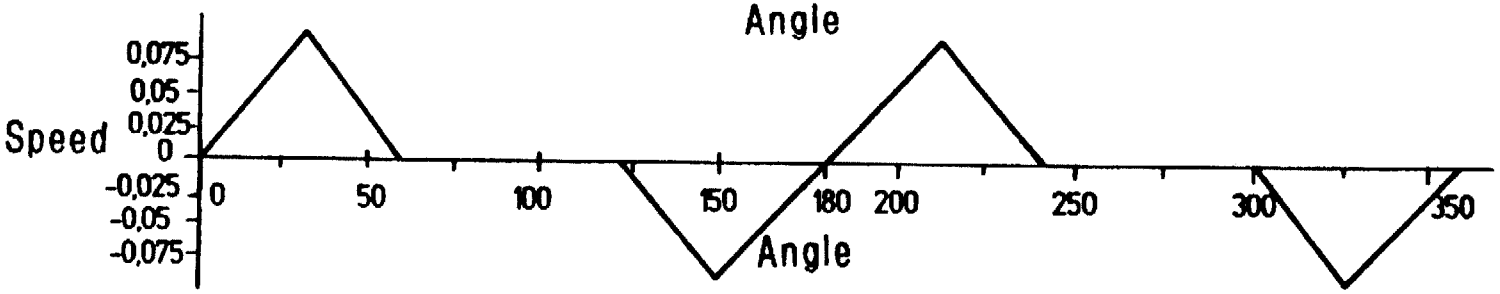
FIG. 3 is a diagram showing a radial speed characteristic of a vane of the vane pump shown in FIG. 1.
Figure 4:
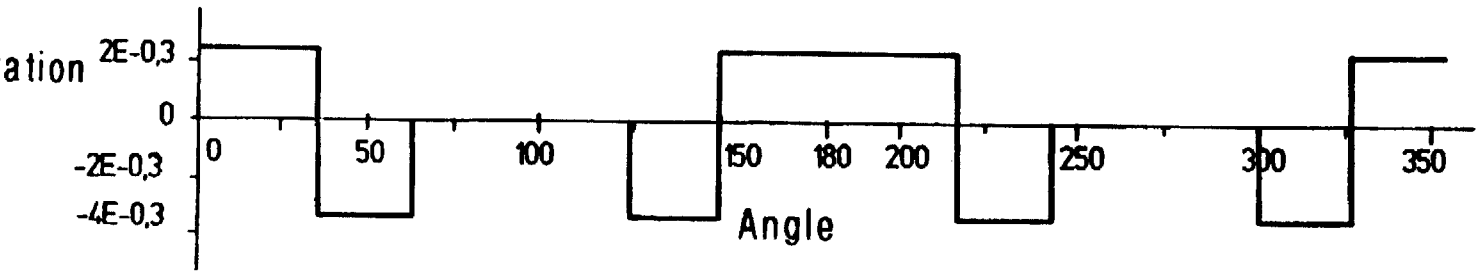
FIG. 4 is a diagram showing a radial acceleration characteristic of the vane of the vane pump shown in FIG. 1.

On the basis of FIGS. 2–4, the dynamics of the vanes 24 at a predetermined constant angular speed of the rotor 20, will be now explained. The diagram of FIG. 2 shows changing of the radial stroke of a vane 24 in accordance with the rotational angle. The curve of FIG. 2 makes it clear that the radial stroke of a vane 24 at 0° and 180°, which correspond to positions designated as A and B in FIG. 1, is minimal. The stroke proceeds, without any abrupt change from a descending branch in the pressure region 32', 32" to an ascending branch in the suction region 30', 30". Therefore, the stroke is minimal only in the angular position of 0° or 180°, and there is no angular region of several degrees having a minimal stroke. Thereby, a continuous transition of the pressure region 32' of the first pump chamber 28' into the suction region 30" of the second pump chamber 28", and of the pressure region 32" of the second pump chamber 28" into the suction region 30' of the first pump chamber 28' takes place. The first separation region 34 is determined exclusively by the position of a vane 24 and, in an extreme case, only by the thickness of a vane 24, when the vane 24 in the 0° or 180° position. Because of the continuous or smooth transition between pressure and suction regions of the two pump chambers, they would be separated in the 0° or 180° position by an imaginary line. However, practically, a vane extends along this imaginary line and, therefore, actual separation region would be defined by the vane thickness. In the separation region 36, i.e., in the angular position between 60° and 120° or between 24° and 300°, the stroke is at its maximum.

The diagram of FIG. 3 shows the change of the speed of a vane 24 in accordance with its angular displacement. The curve shows that the vane 24 has a constantly changing speed in the separation region between the pressure regions 32', 32" and the suction regions 30', 30", with the speed being equal to zero in the position A or B, i.e., at 0° or 180°. The inner contour 26 prevents the vane 24 from retaining a constant speed in the separation region 34. The radial speed changes from a maximum negative value in the pressure region 32', 32", i.e., the vane 24 is radially displaced into the rotor 20, continuously to a maximum positive value in the suction region 30', 30", i.e., the vane 24 is displaced out of the rotor 20. This continuous change of the radial speed, prevents, as it will become clear from the discussion of the diagram of FIG. 4, acceleration jumps in this region. Because of a constant stroke in the separation region 36, the radial speed of a vane 24 in this region is zero.

The diagram of FIG. 4 shows the dependence of the acceleration of the vane 24 on the angular position. The acceleration in the second separation regions 34 and 36 is substantially constant, because the acceleration is determined by the speed differentiation over time. In the first separation region 36, the radial acceleration has a constant magnitude equal to zero. The absence of acceleration jumps in the first and second separation regions 34 and 36 results in the absence of jumps of the vane 24 in these regions, whereby leakage between the pressure regions 32', 32" and the suction regions 30', 30" through the first and second separation regions 34 or 36 is prevented.

Though the present invention was shown and described with reference to the preferred embodiments, various modification thereof will be apparent to those skilled in the art and, therefore, it is not intended that the invention be limited to the disclosed embodiments and details thereof, and departure may be made therefrom within the spirit and scope of the present invention as defined in the appended claims.

What is claimed is:

1. A vane pump, comprising:

a housing;

a cam ring located in the housing and having an inner double-symmetrical contour defining two diametrically opposite pump chambers;

a rotor arranged within the inner contour of the cam ring; and

Six radially displaceable vanes supported on the rotor, spaced from each other by 60°, and displaceable along the inner contour of the cam ring during rotation of the rotor;

wherein the inner contour in a region of each pump chamber is divided in three sections, with a first section forming a suction region, a second section forming a pressure region, and a third section forming a separation region between the suction and pressure regions, and with each section occupying an angular region of 60°, wherein radial acceleration of a vane in the separation region is zero, wherein the inner contour of the cam ring has two smooth regions defining chamber separation regions between the pressure region of one of the pump chambers and the suction region of another of the pump chambers, and the pressure region of the another of the pump chambers and the suction region of the one of the pump chambers, whereby no discontinuous change in a radial speed characteristic of a vane displacement, which is influenced by the inner contour of the cam ring, takes place, and wherein the inner contour of the cam ring has no arcuate regions in the chamber separation regions, and a radial speed of a vane increases continuously in the chamber separation region from a maximum negative speed to a maximum positive speed.

2. A valve pump as set forth in claim 1, wherein the radial speed in the chamber separation region in 0° and 180° positions of the vane is zero.

3. A vane pump as set forth in claim 1, wherein a vane has a constant acceleration in the separation region between the suction and pressure regions of each chamber and in the chamber separation region.

* * * * *